United States Patent [19]

Okamoto et al.

[11] Patent Number: 5,012,770

[45] Date of Patent: May 7, 1991

[54] INTAKE APPARATUS FOR INTERNAL COMBUSTION ENGINE

[75] Inventors: Kazuhisa Okamoto, Yokohama; Fumikazu Ishibashi, Yamato, both of Japan

[73] Assignee: Nissan Motor Co., Ltd., Yokohama, Japan

[21] Appl. No.: 551,385

[22] Filed: Jul. 12, 1990

[30] Foreign Application Priority Data

Jul. 24, 1989 [JP] Japan ..... 1-191138

[51] Int. Cl.[5] ..... F02M 35/10

[52] U.S. Cl. ..... 123/52 MC; 123/52 MB

[58] Field of Search ..... 123/52 M, 52 MB, 52 MC, 123/52 MV

[56] References Cited

U.S. PATENT DOCUMENTS

| | | | |
|---|---|---|---|
| 3,872,843 | 3/1975 | Steinmuller | 123/52 MV |
| 4,619,226 | 10/1986 | Ueda et al. | 123/52 MC |
| 4,653,440 | 3/1987 | Fukuhara et al. | 123/52 MB |
| 4,708,097 | 11/1987 | Hatamura et al. | 123/52 M |
| 4,726,329 | 2/1988 | Atkih | 123/52 MV |
| 4,776,313 | 10/1988 | Freismuth et al. | 123/52 M |
| 4,805,573 | 2/1989 | Macfarlane et al. | 123/52 M |
| 4,886,020 | 12/1989 | Bitter et al. | 123/52 M |
| 4,919,086 | 4/1990 | Shillington | 123/52 MC |

FOREIGN PATENT DOCUMENTS

| | | | |
|---|---|---|---|
| 253305 | 4/1967 | Fed. Rep. of Germany | 123/52 MV |
| 61-53528 | 4/1986 | Japan . | |
| 62-49626 | 3/1987 | Japan . | |
| 63-68764 | 3/1988 | Japan . | |
| 2-20723 | 2/1990 | Japan . | |

*Primary Examiner*—David A. Okonsky

*Attorney, Agent, or Firm*—Pennie & Edmonds

[57] ABSTRACT

In the intake apparatus for an engine including an engine body, an intake manifold and an intake collector, the intake collector is disposed along and fixed to the engine body, and the intake manifold is disposed over the intake collector and removably supported between the engine body and the intake collector. Since the intake collector is fixed to the engine body, vibration of the intake collector can be prevented. Since the intake manifold is easily removed from the engine body and the intake collector, maintenance or repair of various devices arranged on or near the engine body and the intake manifold can be facilitated.

7 Claims, 5 Drawing Sheets

INTAKE APPARATUS FOR INTERNAL COMBUSTION ENGINE

BACKGROUND OF THE INVENTION

1. Field of the Invention

The present invention relates to an improvement of an intake apparatus for an internal combustion engine, and in particular of an intake apparatus provided with both an intake manifold and an intake collector.

2. Description of the Prior Art

In general, there is well known an intake apparatus for internal combustion engines for automotive vehicles provided with both an intake collector for collecting intake air via a throttle valve disposed on the downstream side of an intake passage and an intake manifold for supplying intake air uniformly distributed from the intake collector into each cylinder formed in an engine body, as disclosed in Japanese Published Unexamined (Kokai) Patent Appli. No. 63-68764.

This prior-art intake apparatus will be explained with reference to FIG. 1. An intake manifold 3 is fixed to a side surface of a cylinder head 2 of an engine 1 via a mounting flange 3*a* of the intake manifold 3 with bolts. Further, an intake collector 4 extending in the engine transversal direction is connected to and supported by an upwardly-curved free end 3*b* of the intake manifold 3. Further, a throttle body 6 accommodating twin throttle valves 5 therewithin is connected to a side portion of the intake collector 4 in such a way that a joint surface between the intake collector 4 and the throttle body 6 is declined at an inclination angle with respect to the cylinder axis. This is because the vibration of the throttle body 6 in the engine transversal direction caused when the engine 1 is running can be well suppressed by the intake collector 4.

In the prior-art intake apparatus, however, although it is possible to obtain a vibration suppressing effect to some extent in dependence upon a specific mounting structure between the intake collector 4 and the throttle body 6, since the intake collector 4 itself is connected to and supported by only the intake manifold 3, the supporting rigidity is not sufficient and therefore a large vibration is inevitably produced at both the intake collector 4 and the throttle body 6, when the engine is running.

In addition, since the intake collector 4 is connected to the upper surface of the free end 3*b* of the intake manifold 3, when the cylinder head 2 or fuel injection valves 7 disposed inside the intake manifold 3 are required to be removed from the engine 1 during maintenance or repair of the engine 1 or fuel injection valves 7, for instance, the intake collector 4, the throttle body 6, an intake duct connected to the throttle body 6 must be all disassembled and removed from the engine, thus resulting in an extremely troublesome maintenance and inspection work and therefore a low workability.

Further, after having been reassembled, since a number of check points such as bolt fastening, etc. are required, there exists another problem in that the working reliability is subjected to the influence of repairman's skillfulness.

SUMMARY OF THE INVENTION

With these problems in mind, therefore, it is the primary object of the present invention to provide an intake apparatus for on internal combustion engine in which an intake collector is directly connected to an engine body and further an intake manifold is removably mounted on the engine body and the intake collector for providing an easy repair or maintenance.

To achieve the above-mentioned object, the intake apparatus for an engine, according to the present invention, having an engine body composed of a cylinder head (13) and a cylinder block (12) formed with a plurality of engine cylinders; an intake manifold (15) for supplying intake air into the engine cylinders, respectively; and an intake collector (14) for distributing intake air into the intake manifold, wherein said intake collector (14) is disposed along and fixed to the engine body; and said intake manifold (15) is disposed over said intake collector and removably supported by said engine body and said intake collector.

The intake collector is fixed to the engine body with plural brackets (23, 24, 25, 26). One end of each bracket is fixed to the cylinder block or the cylinder head, and the other end of each bracket is fixed to the intake collector.

Further, the cylinder head (13) is formed with an upper intake manifold mounting flange (17); said intake collector (14) is formed with a lower intake manifold mounting flange (22); and said intake manifold (15) is formed with an upper flange (29) connectable to the upper intake manifold mounting flange (17) of the cylinder head and a lower flange (31) connectable to the lower intake manifold mounting flange (22) of said intake collector.

In the intake apparatus for an internal combustion engine according to the present invention, since the intake collector is connected to and supported by not only the intake manifold but also the engine body, it is possible to markedly increase the supporting rigidity of the intake collector and therefore to sufficiently suppress the vibration of the intake collector and the throttle body caused when the engine is running.

Further, since the intake collector is supported by the engine body and further the intake manifold is removably mounted on the intake collector and the engine, it is unnecessary to remove the intake collector together with other elements during engine maintenance and repair; that is, only the intake manifold can be removed independently. Therefore, it is possible to facilitate the maintenance and repair work and reduce the number of check points after the engine has been reassembled.

DETAILED DESCRIPTION OF THE PREFERRED EMBODIMENTS

Embodiments of the present invention will be described in further detail hereinbelow with reference to the attached drawings.

Figure 1:
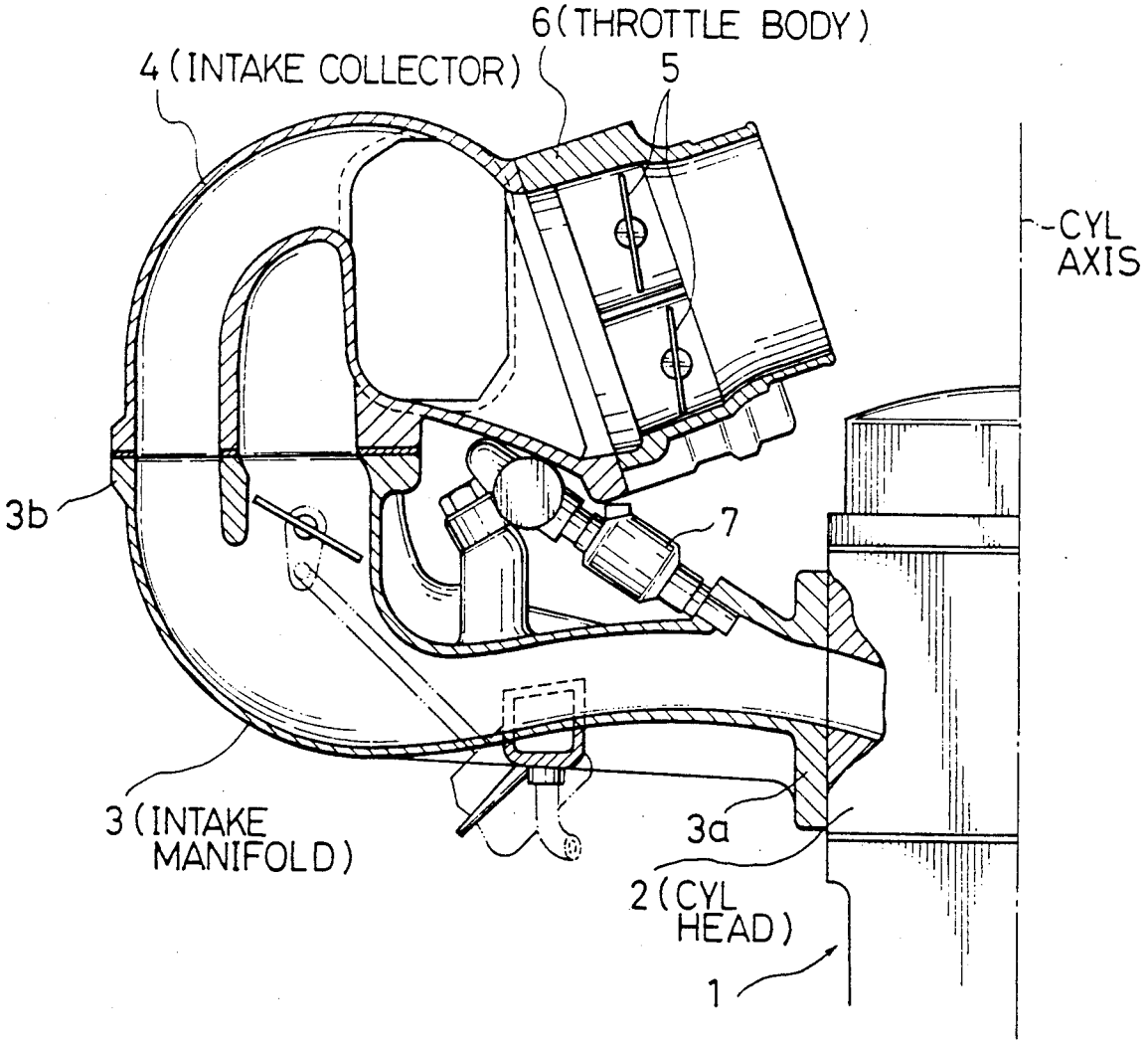
FIG. 1 PRIOR ART
FIG. 1 is a partial cross-sectional view of a prior-art intake apparatus.
Figure 2:
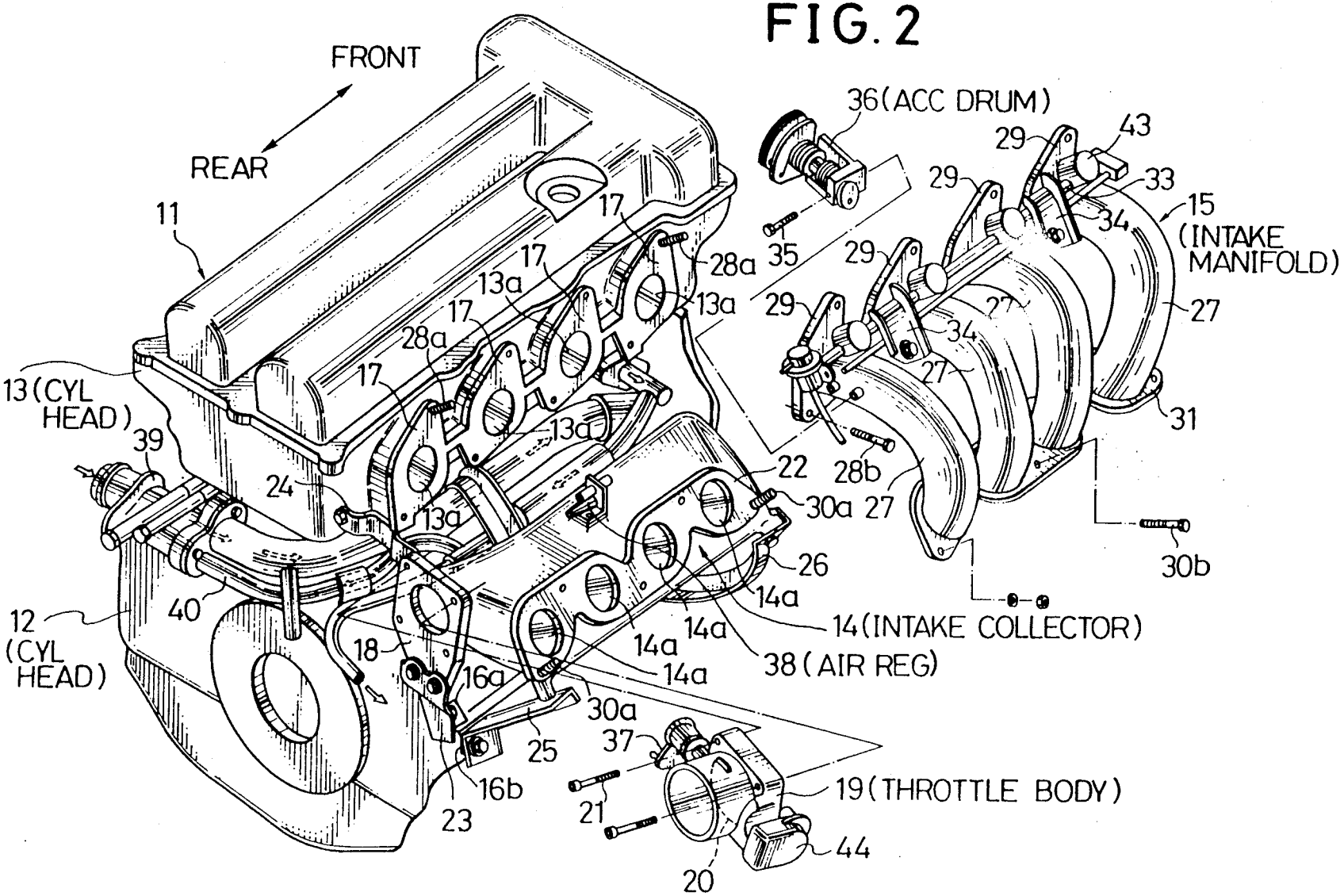
FIG. 2 is a perspective and partially exploded view showing an embodiment of the intake apparatus for an internal combustion engine according to the present invention.
Figure 3:
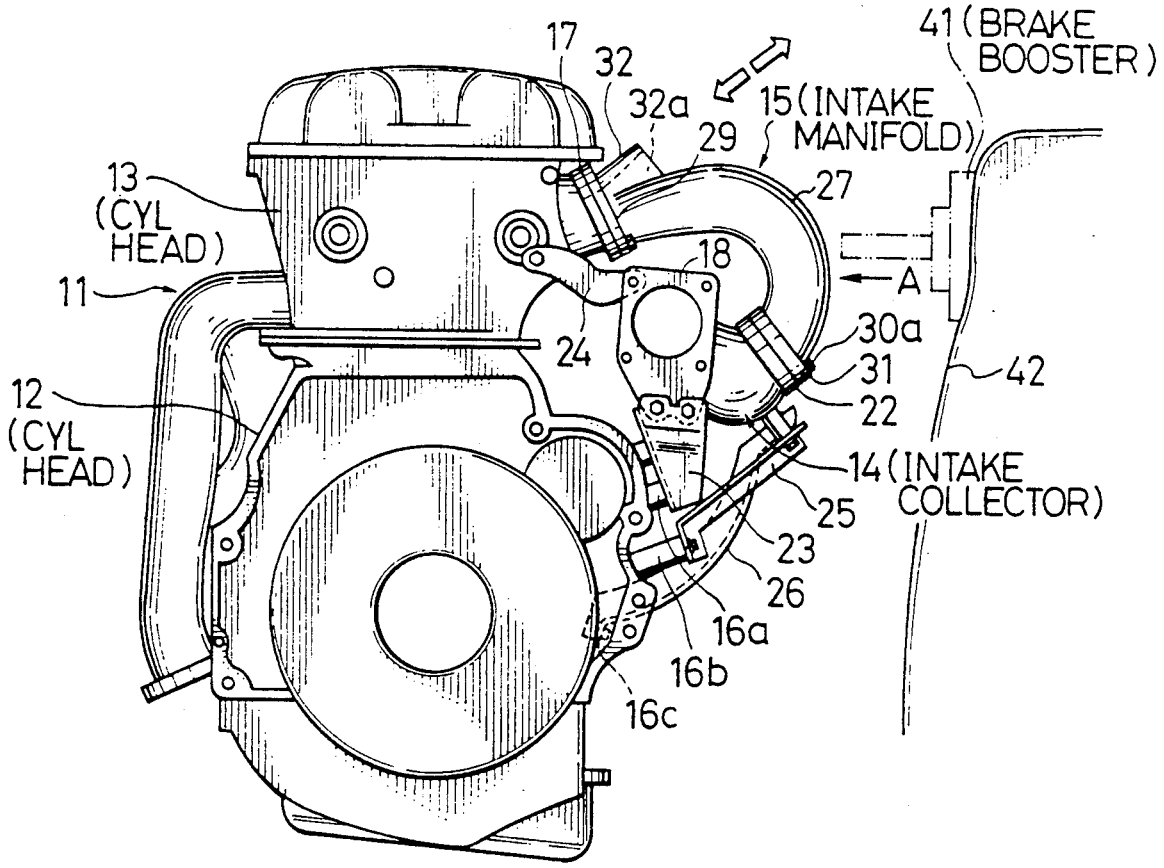
FIG. 3 is a front view showing the intake apparatus shown in FIG. 2.
Figure 4:
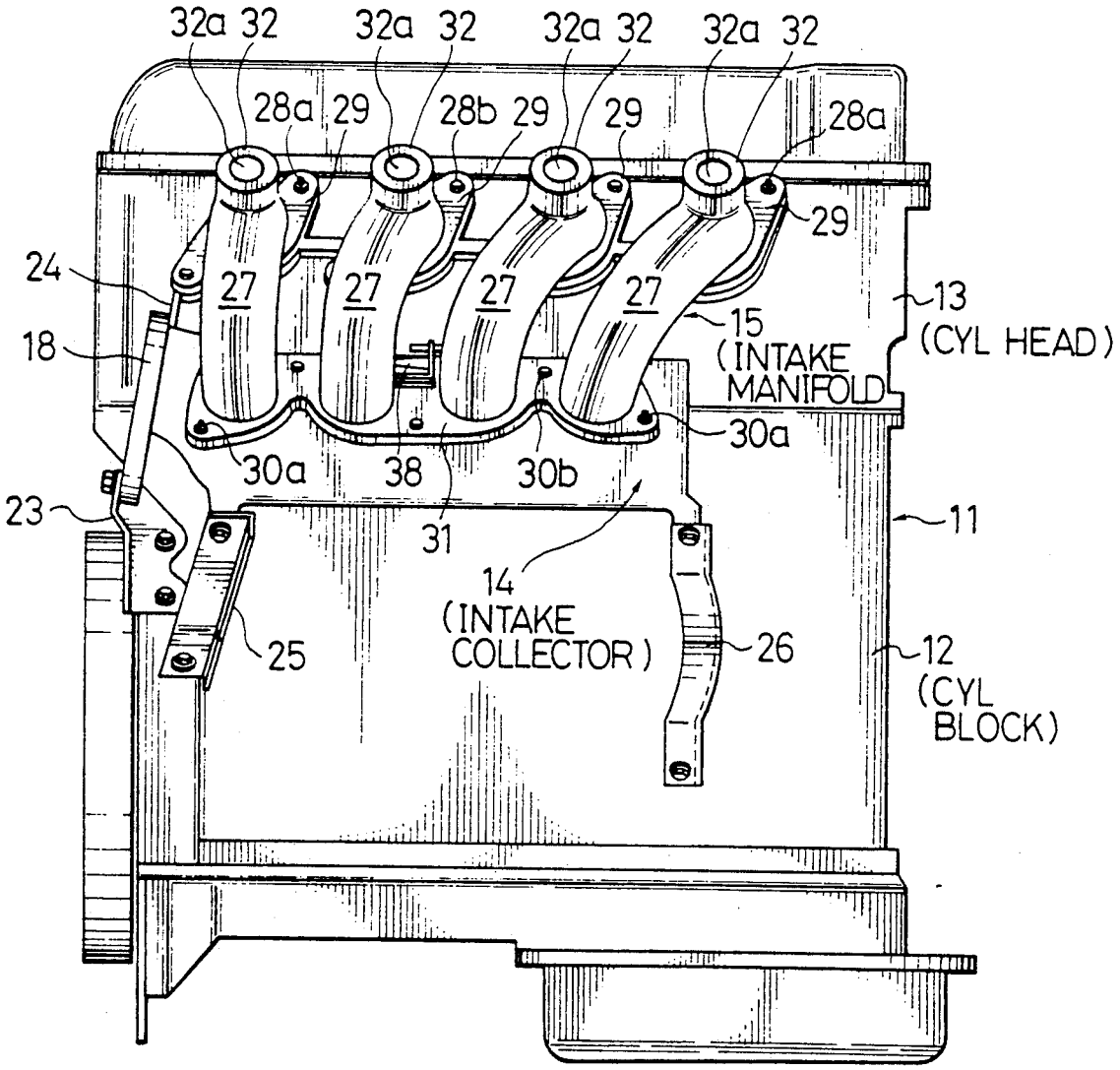
FIG. 4 is a side view showing the intake apparatus when seen from the arrow direction A in FIG. 3.

FIGS. 2 to 4 show an embodiment of the present invention. A series-connected 4-cylinder engine 11 disposed in the vehicle transversal direction within an engine room comprises a long-skirt type cylinder block 12, a cylinder head 13 disposed on the cylinder block 12, an intake collector 14 disposed on the downstream side of an intake passage, and an intake manifold 15 disposed over the intake collector 14. Further, three threaded boss portions 16*a*, 16*b* and 16*c* (shown in FIG. 3) are formed integral with the cylinder block 12 at predetermined positions on the outer side surface of the cylinder block 12 and below the intake collector 14. Further, 4-series arranged (upper intake manifold) mounting flanges 17 are formed integral with the cylinder head 13 on the outer side surface on each of which an intake port 13*a* is formed.

The intake collector 14 is formed into roughly a box-shape extending along the upper outer side surface of the cylinder block 12 in the engine longitudinal direction. A throttle body 19 having a throttle valve therewithin is connected to the side mounting flange 18 (shown in FIG. 2) of the intake collector 14 with bolts 21 (shown in FIG. 2). A flange-shaped (lower intake manifold) mounting portion 22 having 4 intake ports 14*a*, respectively are formed upwardly on the side of the intake collector 14 at regular intervals along the engine longitudinal direction. This intake collector 14 is connected to and supported by the cylinder block 12 and the cylinder head 13 via 4 brackets 23, 24, 25 and 26 (shown in FIGS. 2, 3 and 4). In more detail, the lower end portion of the mounting frange 18 is connected to and supported by a boss portion 16*a* of the rear end of the cylinder block 12 via a first triangular roughly L-shape-bent bracket 23 (shown in FIGS. 2, 3 and 4). The upper end portion of the mounting frange 18 is connected to and supported by the rear outer side surface of the cylinder head 13 via a second roughly L-shape-bent bracket 24 (shown in FIGS. 2, 3 and 4). The rear lower end portion of the mounting flange 22 of the intake collector 14 is connected to and supported by a boss portion 16*b* (shown in FIGS. 2 and 3) formed at the lower end of the skirt portion formed at the rear end of the cylinder block 12 via a third L-shape-bent bracket 25.

Further, the front lower end portion of the mounting flange 22 (shown in FIG. 2) is connected to and supported by a boss portion 16*c* (shown in FIG. 3) formed at the lowermost end of the skirt portion formed at the front end of the cylinder block 12 via a fourth arcuated bracket 26. Further, the mounting portion 22 of the intake collector 14 is formed roughly in parallel to the mounting flange 17 of the cylinder head 13, and two stud bolts 30*a* at the mounting portion 22 are arranged also roughly in parallel to stud bolts 28*a* implanted at the mounting flange 17.

Figure 5:
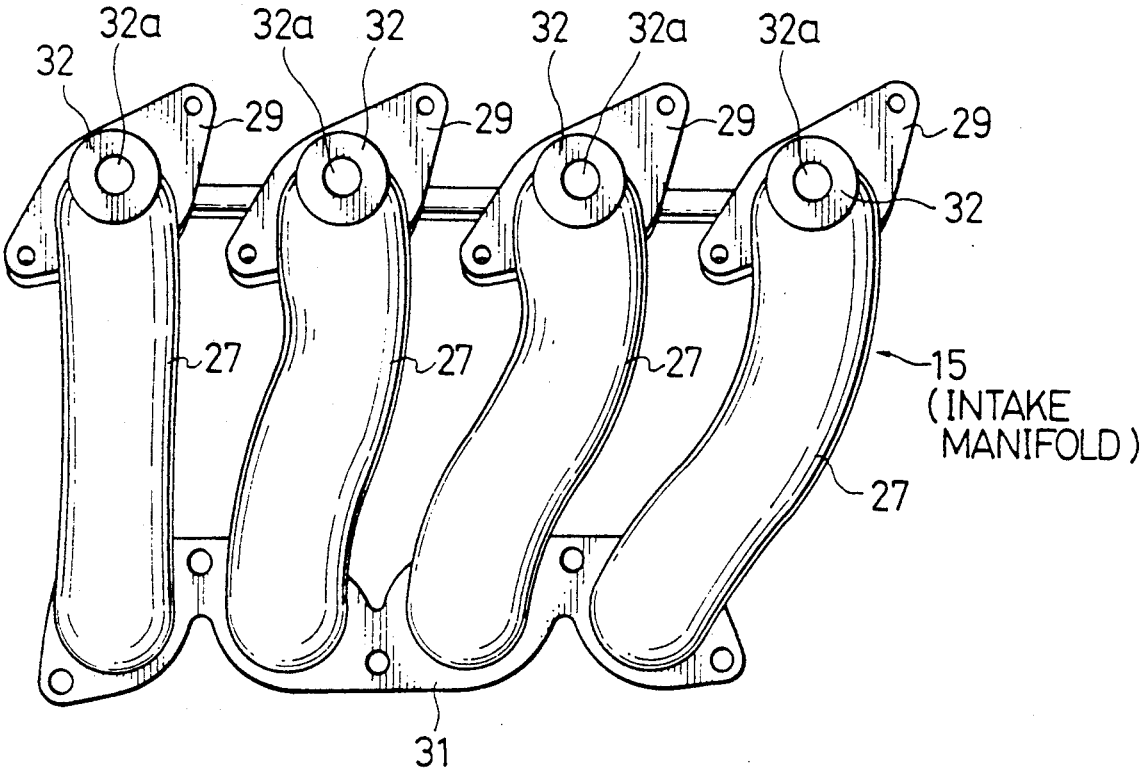
FIG. 5 is a front view showing an intake manifold incorporated in the intake apparatus according to the present invention.

As also shown in FIGS. 2 and 3, the intake manifold 15 is formed with four downward arcuately bent branch pipes 27. The branch pipes 27 are formed with four upper mounting flanges 29, respectively on the upper end thereof so as to be connected to the mounting flanges 17 of the cylinder head 13 with two stud bolts 28*a* and six bolts 28*b*. Further, the branch pipes 27 are formed with three lower mountings flanges 31, respectively on the lower end thereof so as to be connected to the mounting flange 22 of the intake collector 14 with the two stud bolts 30*a* and three bolts 30*b*. These upper and lower mounting flanges 29 and 31 of the intake manifold 15 are formed roughly in parallel to each other. Therefore, the intake manifold 15 can be removably mounted on the cylinder head 13 and the intake collector 14 via these mounting flanges 29 and 31. Further, each flange 29 of each branch pipe 27 of the intake manifold 15 is formed with a boss portion 32 (shown in FIG. 5) having a mounting hole 32*a* into which a fuel injection valve 43 (shown in FIG. 2) is fitted on the upper joint portion of the flange 29. A fuel pipe 33 (shown in FIG. 2) is disposed so as to pass through these mounting holes 32*a* in the engine longitudinal direction, and supported by two pipe support members 34 at both the sides sides of the fuel pipe 33 and near the outer edge of the boss portion 32 (shown in FIG. 4). Further, an accelerator drum 36 (shown in FIG. 2) is fixed to the outside of the rear side branch pipe 27 with a bolt 35. This accelerator drum 36 is linked with a throttle drum 37 (shown in FIG. 2) of the throttle valve 20 via a linkage disposed vertically (not shown).

Further, an air regulator 38 (shown in FIG. 2) for controlling the amount of intake air when the engine is being idled is mounted and fixed to the upper middle surface of the intake collector 14, and a coolant bypass pipe 40 (shown in FIG. 2) is disposed between the cylinder block 12 and the intake collector 14 in order to return coolant discharged from a water jacket within the cylinder head 13 to a water pump via a thermostat housing 39 (shown in FIG. 2). Further, in FIG. 3 the reference numeral 41 denotes a brake booster projectingly disposed from a dashboard 42 facing the engine room toward the vehicle front. The front end of this brake booster 41 extends to near the intake manifold 15.

The function of the embodiment will be described hereinbelow.

According to the present embodiment, since the intake collector 14 is connected to and supported by the intake manifold 15 at the upper end thereof and by the cylinder block 12 and the cylinder head 13 by the four brackets 23, 24, 25 and 26 at the lower end side surface thereof, it is possible to markedly increase the supporting rigidity of the intake collector 14. Therefore, it is possible to sufficiently suppress vibration of the intake collector 14 caused when the engine is running. In particular, since the front end at which the heavy throttle body 19 is mounted is supported by the first and second brackets 23 and 24 at two points, the supporting rigidity of the intake collector 14 can be increased near the throttle body 19 and therefore vibration thereof can be well suppressed.

As a result, it is possible to securely prevent the deterioration of sealing performance between the intake collector 14 and the throttle body 19, the maloperation of the throttle valve 20, and therefore the deterioration of detection precision of a throttle valve opening rate sensor 44 disposed on the throttle body 19.

In addition, since the intake manifold 15 is located over the intake collector 14 and further removably mounted on the intake collector 14 and the cylinder head 13, it is possible to repair or check the intake manifold 15 or other elements disposed near the manifold 15 (e.g. the brake booster 41) by only unfastening the bolts for removal of the intake manifold 15, without removing the intake collector 14 and the throttle body 19. Further, it is possible to repair the air regurator 38 disposed inside the intake manifold 15 by removing only the intake manifold 15.

As described above, whenever the engine 11 or other elements arranged near the intake manifold 15 are repaired or checked, since it is unnecessary to remove the intake collector 14 conventionally required for repair, the working efficiency can be improved markedly. Further, since the number of check points (e.g. bolt fastening confirmation) required after reassembly can be reduced, it is possible to prevent a difference in work precision according to the repairmen.

Further, since the fuel injection valves 43 are mounted on the upper end portions of the downwardly bending branch pipes 27, respectively, it is also possible to facilitate repairing of these fuel injection valves 43. Further, since the linkage between the accelerator drum 36 and the throttle drum 37 is disposed vertically (not horizontally), it is possible to prevent the linkage from being vibrated by the weight itself and therefore from being worn away at the linked position. Further, since the four stud bolts 28*a* and 30*a* fixed to the mounting flange 17 of the cylinder head 13 and the mounting flange 22 of the intake collector 14 are located so as to correspond to four corners of the intake manifold 15, as a whole, via the mounting flanges 29 and 31 of the intake manifold 15, it is possible to locate the intake manifold 15 to the cylinder head 13 and the intake collector 14 at high precision during assembly.

Further, in the above embodiment, the intake collector 14 is supported by four brackets 23, 24, 25 and 26 at four points. Without being limited thereto, however, it is possible to support the intake collector 14 at two or more points.

As described above, in the intake apparatus according to the present invention, since the intake collector is connected to and supported by not only the intake manifold but also by to engine body, the supporting rigidity of the intake collector can be increased markedly, so that it is possible to effectively reduce vibration of the intake collector and the throttle body, when the engine is running.

In addition, since the intake manifold can be removed independently from the engine body and the intake collector, the engine, the intake manifold, and other devices arranged near the intake manifold can be repaired or checked easily, so that the working efficiency can be improved markedly; the number of check points after reassembly can be reduced; and therefore difference in work precision according to repairmen can be eliminated.

What is claimed is:

1. An intake apparatus for an engine having an engine body composed of a cylinder head and a cylinder block formed with a plurality of engine cylinders; an intake manifold for supplying intake air into the engine cylinders, respectively; and an intake collector for distributing intake air into the intake manifold, wherein said intake collector is disposed along and fixed to the engine body; and said intake manifold is disposed over said intake collector and removably supported by said engine body and said intake collector.

2. The intake apparatus for an engine of claim 1, which further comprises means for fixing said intake collector to one side surface of said engine body.

3. The intake apparatus for an engine of claim 2, wherein said intake collector fixing means comprises at least two brackets for fixing said intake collector to said engine body at both longitudinal ends of said intake collector.

4. The intake apparatus for an engine of claim 3, wherein one end of each of said brackets is fixed to the cylinder block and the other end thereof is fixed to a longitudinal end of said intake collector.

5. The intake apparatus for an engine of claim 3, wherein one end of each of said bracket is fixed to the cylinder head and the other end thereof is fixed to a longitudinal end of said intake collector.

6. The intake apparatus for an engine of claim 1, wherein the cylinder head is formed with an upper intake manifold mounting flange; said intake collector is formed with a lower intake manifold mounting flange; and said intake manifold is formed with an upper flange connectable to the upper intake manifold mounting flange of the cylinder head and a lower flange connectable to the lower intake manifold mounting flange of said intake collector.

7. The intake apparatus for an engine of claim 6, which further comprises at least two stud bolts implanted at the upper and lower intake manifold mounting flanges, respectively for location of said intake manifold to said cylinder head and said intake collector.

* * * * *